US008850674B1

(12) United States Patent
Schechter et al.

(10) Patent No.: US 8,850,674 B1
(45) Date of Patent: Oct. 7, 2014

(54) NUT PLATE FOR PIERCED EARRINGS

(75) Inventors: Joel Schechter, New York, NY (US); Mossig Makhoulian, New York, NY (US)

(73) Assignee: Richline Group, Inc., New York, NY (US)

( * ) Notice: Subject to any disclaimer, the term of this patent is extended or adjusted under 35 U.S.C. 154(b) by 31 days.

(21) Appl. No.: 13/418,075

(22) Filed: Mar. 12, 2012

Related U.S. Application Data

(60) Provisional application No. 61/452,344, filed on Mar. 14, 2011.

(51) Int. Cl.
*A44C 7/00* (2006.01)

(52) U.S. Cl.
USPC ..... 24/705; 63/35; 63/12

(58) Field of Classification Search
USPC ..... 24/705; 63/12, 13
See application file for complete search history.

(56) References Cited

U.S. PATENT DOCUMENTS

| | | | | |
|---|---|---|---|---|
| 3,630,048 | A | 12/1971 | Masters | |
| D265,895 | S | 8/1982 | Barr | |
| 4,408,375 | A * | 10/1983 | Skobel | 24/615 |
| 4,630,453 | A | 12/1986 | Burkett | |
| 5,513,502 | A * | 5/1996 | Seaton, Jr. | 63/14.4 |
| 5,537,841 | A | 7/1996 | Bradvica | |
| D390,151 | S | 2/1998 | Blum et al. | |
| 5,906,114 | A * | 5/1999 | Rissin | 63/33 |
| D461,140 | S | 8/2002 | Benhamou | |
| 6,571,579 | B1 * | 6/2003 | Rissin | 63/33 |
| 7,818,852 | B2 | 10/2010 | Van der Greft | |
| 2002/0124364 | A1 | 9/2002 | Rissin | |
| 2009/0019891 | A1 * | 1/2009 | Kent | 63/14.3 |

FOREIGN PATENT DOCUMENTS

| | | |
|---|---|---|
| GB | 2305109 | 4/1997 |
| WO | WO 2006/134184 A1 | 12/2006 |

* cited by examiner

*Primary Examiner* — Jack W Lavinder
(74) *Attorney, Agent, or Firm* — Levisohn Berger LLP

(57) ABSTRACT

A novel pierced earring for pierced ears which includes a rear plate attached to the pin, the rear plate forming the nut and having a peripheral shape approximating that of the rear portion of the lobe of the ear to provide substantial bearing surface against the rear of the lobe.

2 Claims, 5 Drawing Sheets

PRIOR ART

NUT PLATE FOR PIERCED EARRINGS

RELATED APPLICATION

This application claims the priority of provisional patent application Ser. No. 61/452,344, filed Mar. 14, 2011, the contents of which is incorporated herein by reference.

BACKGROUND OF THE INVENTION

This invention relates to earrings for pierced ears in which an earring is attached to a post, the post passing through a pierced ear and being secured on the ear with a nut slid onto the post bearing against the rear of the earlobe holding the earring in place.

Prior art nuts are round and larger round nuts are provided for larger pierced earrings. Such round structure is conventionally utilized for pierced earrings.

Pierced ears holding earrings provide structural support for the earrings. When earrings are larger, the conventional pin or post sliding through the pierced ear and being held by prior art small nuts places structural pressure at the intersection of the pin as it passes through the pierced ear. This is undesirable since it may place too much pressure on the ear and otherwise distort the wearing of the earring because the earring placing such pressure on the pierced ear with the prior art conventional nut may not hang as cleanly and be as properly supported as desirable. Additionally for larger earrings with larger round nuts, the nuts may not be hidden behind the ears.

An object of this invention is to provide an improved nut as part of a pierced earring post assembly.

Another object of this invention is to provide such an improved pierced ear post nut which provides improved support for the earring worn in a pierced ear.

Yet another object of this invention is to provide an improved pierced earring post nut which enables large size earrings to be worn in a most attractive and comfortable fashion.

Other objects, advantages and features of this invention will become more apparent from the following description.

SUMMARY OF THE INVENTION

In accordance with the features of this invention and to satisfy the above objects and others, this invention provides an inverted egg shaped elongated rounded shape planar surface for the earring nut, which planar surface will bear against the rear of the lobe of the pierced ear. The planar surface takes the general shape of the lobe of the ear. The larger surface bearing on and conforming to the shape of the rear surface of the lobe of the pierced ear provides improved structural support for the earring as worn.

The size and round shape of the plate in prior art nuts serves little purpose other than to capture the pin and hold the earring. This invention provides the nut with a plate surface which substantially conforms to the shape of the ear lobe and bears on the rear surface thereof. The plate may be solid or have an opening or aperture therein, but the peripheral edge of the plate will substantially have a surface structure which conforms to the ear lobe shape. Ear lobe shapes are unique to each person but have a substantially standard silhouette.

DETAILED DESCRIPTION OF THE PREFERRED EMBODIMENT

Figure 1:
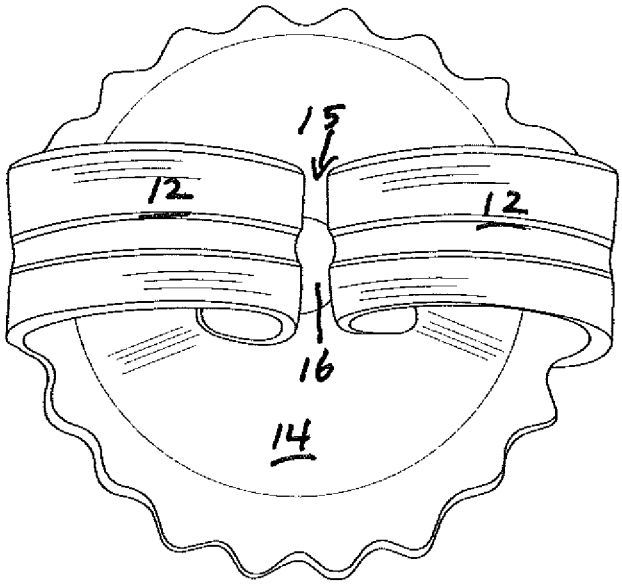
FIG. 1 PRIOR ART
FIG. 1 is a rear plan view of the prior art nut.
Figure 2:
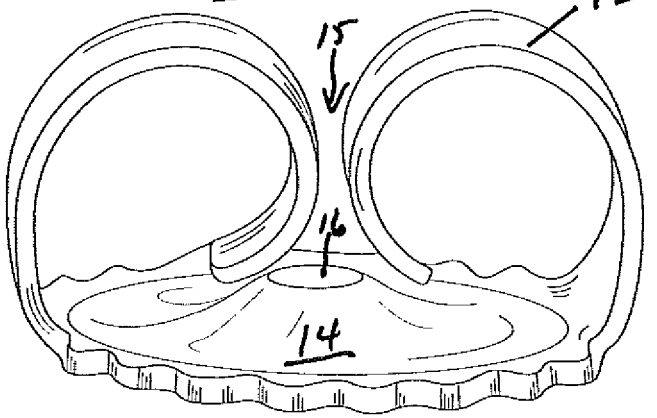
FIG. 2 is a side perspective view of the prior art nut of FIG. 1.
Figure 3:
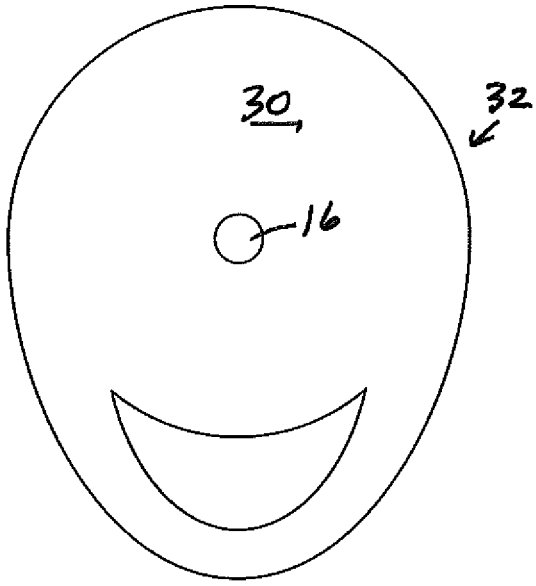
FIG. 3 is a front plan view of the plate forming the nut of the invention herein.
Figure 4:
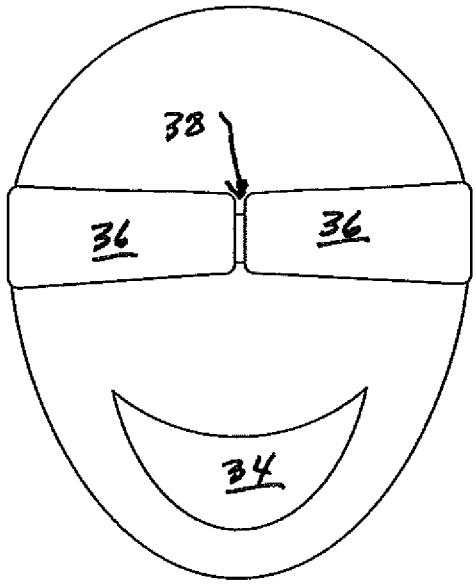
FIG. 4 is a rear plan view of the nut of FIG. 3.
Figure 7:
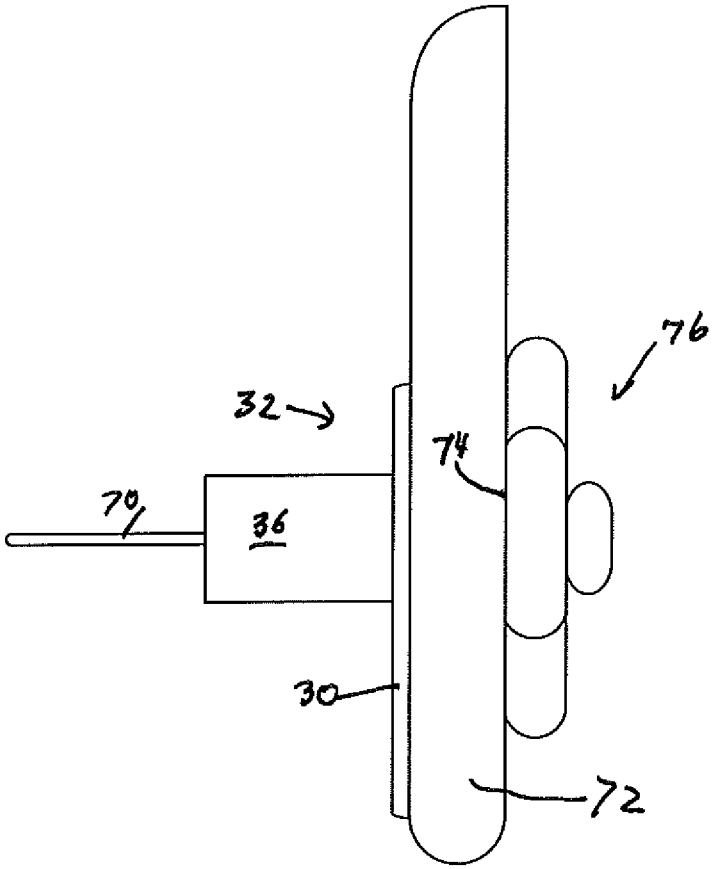
FIG. 7 is an edge plan view showing the pin attached to an earring passing through the plate of the invention with the ear lobe between the nut and earring structure.
Figure 7A:
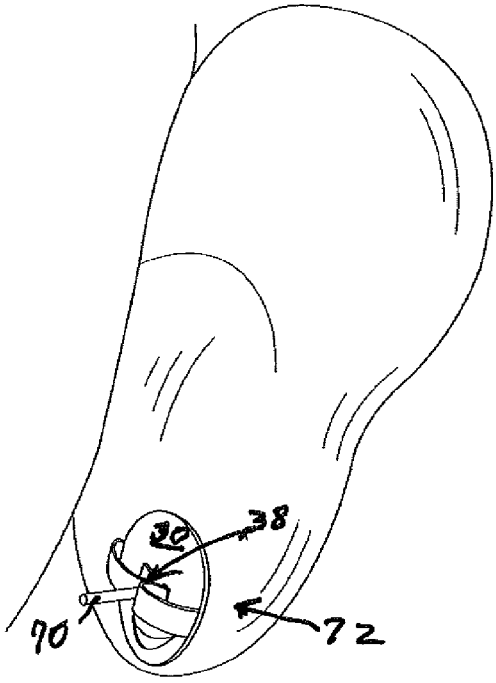
FIGS. 7*a* and 7*b* are perspective views showing the nut of this invention in place behind the lobe of the ear.

FIGS. 1 and 2 shows the prior art nut 10 in which there are butterfly wings 12 shown folded towards nut plate 14 for forming a catch 15 to capture a pin which is attached to an earring (not shown in this figure but shown in FIGS. 7 and 7*a*). The pin passes through aperture 16. The pin is fixedly attached to an earring in a standard manner (see FIG. 7). As can be seen in FIGS. 1 and 2, the surface of plate 14 of the prior art nut is relatively small and substantially circular.

FIGS. 3-7, 7*a* and 7*b* show the present invention in which the plate 30 for the nut 32 has a shape or silhouette approximating that of the lobe 72 of an ear. Plate 30 is substantially flat but need not be.

Plate 30 is elongated and longer from top to bottom than the prior art round plates 14. The plate 30 is rounded at its periphery and substantially is an inverted egg shape providing greater support for the ear lobe 72. Such shape approximates standard ear lobe shapes.

In order to save metal material, plate 30 for the nut 32 may have an aperture or opening 34 formed within the boundary or silhouette of plate 30. Aperture 34 may be eliminated if desired.

The nut 32 of this invention is formed similar to that of the prior art with arms 36 folded over to nearly touch to form catch 38 on the rear side of the plate 30, so that a pin 70 (see FIG. 7*a*) is captured at catch 38 formed between folded or bent arms 36. The larger rounded elongated substantially inverted egg shaped surface for the plate 30 of nut 32 generally conforms to the contour of the ear lobe to provide improved support for the rear of the lobe. The entirety of the plate 30 bears against the rear of the lobe to provide broader structural support for the earring, allowing less pressure on the ear and providing better performance when the earring is worn.

The size of the lower portion of plate 30 may be approximately the size of the ear lobe below the pierced hole in the ear.

Figure 5:
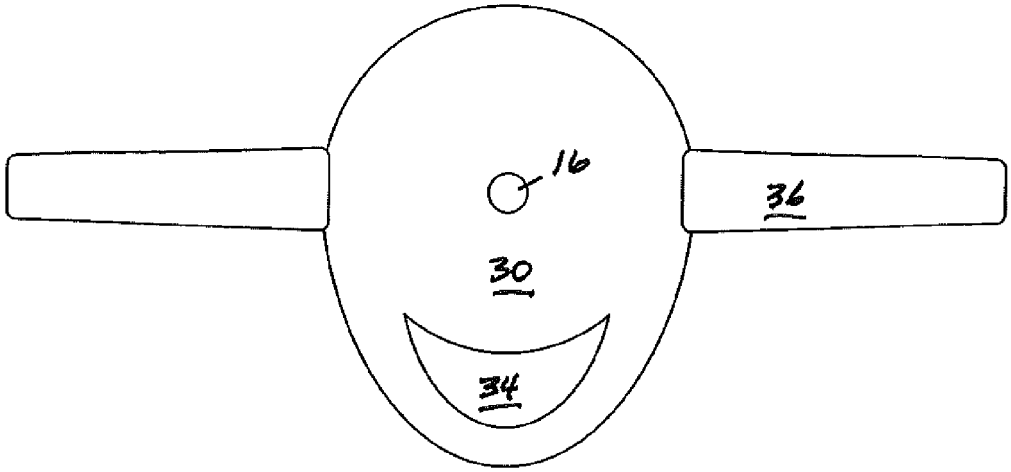
FIG. 5 is a rear plan view similar to FIG. 4 with the wings forming the catch shown flat before being bent to form the catch.
Figure 6:
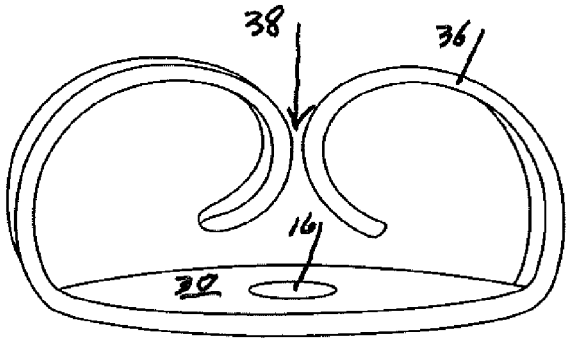
FIG. 6 is an edge plan view of the nut of FIG. 4 showing the wings bent to form the catch.

As another feature of this invention, the nut 32 is formed of a one piece stamped metal piece having arms 36 extending outwardly. This manufacturing process stamps the metal as shown in FIG. 5 and then folds the arms 36 into facing position to form catch 38 to capture pin 70.

Figure 7B:
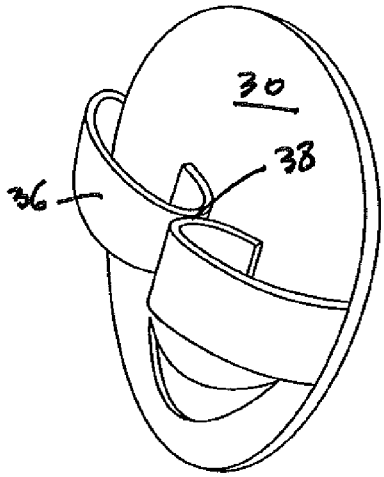

FIGS. 7, 7*a* and 7*b* shows the nut 32 of this invention capturing pin 70 with pin 70 attached to the rear surface 74 of earring 76 in the conventional manner with the ear lobe 72 captured between the rear 74 of earring 76 and plate 30.

It should be understood that the preferred embodiment was described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly legally and equitably entitled.

The invention claimed is:

1. A nut for pierced earrings in which the nut holds a pin attached to the rear of said earring, said pin adapted to pass through a hole in said nut to hold said earring on a lobe portion of a pierced ear, said pin being held in a catch of said nut, said nut comprising:

a plate and said catch integrally formed in which said pin is adapted to be held in said nut behind a lobe of an ear, said plate having a substantially flat planar surface which bears against the rear surface of a lobe of an ear, said plate having substantially front and rear flat surfaces parallel to each other, said plate having a rounded periphery, said plate having an aperture within the periphery of said plate, wherein said aperture is located toward the bottom of said plate below said hole, said aperture being substantially larger and at least four times larger in size than said hole, said aperture formed within the silhouette of the plate.

2. A nut for pierced earrings as set forth in claim 1, wherein said plate is substantially oblong and narrower below said hole than above said hole.

* * * * *